United States Patent [19]

Guinot

[11] 4,218,171

[45] Aug. 19, 1980

[54] PUBLIC WORKS MACHINE INCLUDING CONTROL JACKS IN A BOOM BALANCE ASSEMBLY

[75] Inventor: Gabriel L. Guinot, Le Plessis-Belleville, France

[73] Assignee: Societe Anonyme de Droit Francais, Poclain, Le Plessis-Belleville, France

[21] Appl. No.: 898,777

[22] Filed: Apr. 21, 1978

[30] Foreign Application Priority Data

May 4, 1977 [FR] France ..... 77 13570

[51] Int. Cl.[2] ..... E02F 3/75

[52] U.S. Cl. ..... 414/694; 414/707; 414/917

[58] Field of Search ..... 414/694, 707, 786, 917

[56] References Cited

U.S. PATENT DOCUMENTS

| | | | |
|---|---|---|---|
| 1,371,344 | 3/1921 | Brackett | 414/694 |
| 3,251,490 | 5/1966 | Guinot | 414/694 |
| 3,792,786 | 2/1974 | Goikhburg et al. | 414/694 |
| 3,952,890 | 4/1976 | Armstrong | 414/694 |
| 4,103,791 | 8/1978 | Ullmann | 414/694 |

*Primary Examiner*—L. J. Paperner
*Attorney, Agent, or Firm*—Lewis H. Eslinger

[57] ABSTRACT

The present invention relates to a method for determining the locations of the two hydraulic jacks for controlling an assembly of two pivoted arms, the first arm, called boom or jib, pivoted on the frame of a public works machine, such as a loader or a hydraulic shovel, and the second arm, called balance beam, pivoted on the first arm, while a bucket, adapted to rest on the ground during loading, is coupled to said balance beam, each of said two jacks is coupled between the frame and the balance beam, at least one of the axes of coupling of one of the jacks being separate from the axis of coupling of the other jack on the same element—frame or balance beam—and the instantaneous centers of rotation of the bucket, corresponding respectively to the functioning of each of the control jacks when the bucket is near the ground, are chosen to be on the longitudinal axis of the boom, wherein the first instantaneous center of rotation is chosen to be near the ground, the second instantaneous center of rotation is chosen to be substantially perpendicular with respect to the position of the bucket resting on the ground at the moment of loading and wherein the longitudinal axes of the control jacks are placed on radii passing respectively through each of said centers of rotation, the axes of coupling of the jacks to the balance beam and to the frame being determined by the intersections of said radii with each of these elements.

The invention is more particularly applied to the production of a high yield loader.

10 Claims, 5 Drawing Figures

Figure 1:
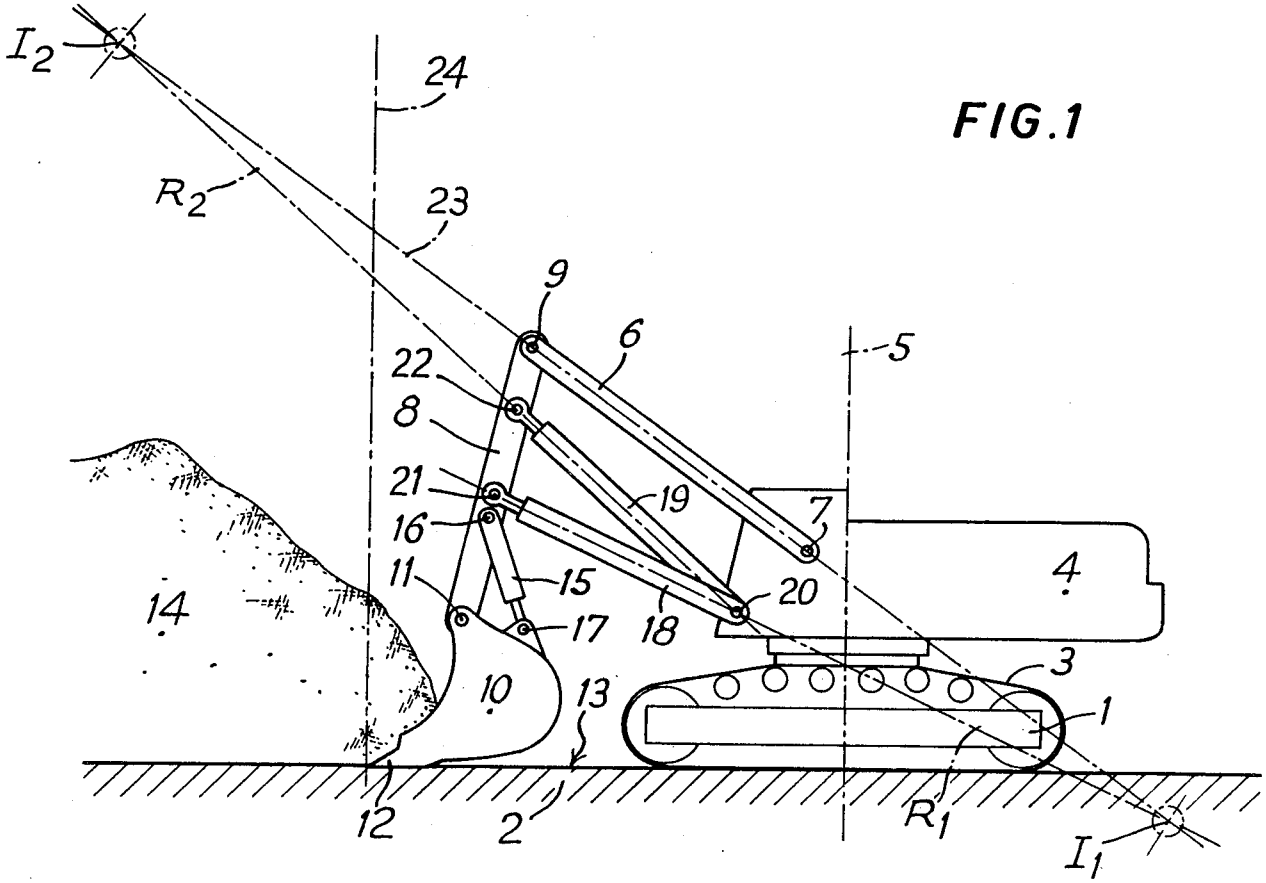

1
2
3
4
5
6
7
8
9
10
11
12
13
14
15
16
17
18
19
20
21
22
23
24
$I_1$
$I_2$
$R_1$
$R_2$

PUBLIC WORKS MACHINE INCLUDING CONTROL JACKS IN A BOOM BALANCE ASSEMBLY

The present invention relates to a method for determining the locations of the jacks controlling a boom-balance beam assembly.

According to the prior art, to make a loader, there is mounted on a mobile frame an assembly of pivoted arms, a first arm pivoted on the frame, a second arm on the first arm, whilst a bucket is coupled to the end of the second arm. The position of the bucket is adjusted not only with respect to the said second arm, but also by regulating the position of the arms themselves. To this end, two separate regulating members are employed, generally constituted by hydraulic jacks, and diversely coupled.

The following arrangements have already been adopted:

- a jack is coupled between the frame and the first arm, another jack being coupled between the two arms;
- a jack is coupled between the frame and the first arm, another jack being coupled between the frame and the second arm;
- a jack is coupled between the two arms, another jack being coupled between the frame and the second arm; finally,
- the two jacks are each coupled between the frame and the second arm, the pivot axes of the two jacks on at least one of these elements—frame and second arm—being separate.

Now, it is noted that the known arrangements, as produced, are unsuitable for procuring an entirely satisfactory movement of the bucket of the loader, at least at the moment of penetration into the material to be displaced and at the moment of lifting the filled bucket. In particular, the penetration is not effected along an axis sufficiently near the horizontal, this being, however, desirable, whilst the lifting is effected in a direction which is oblique with respect to the vertical and which comprises a non-negligible component in the direction of penetration. Despite the inadequate character of the movement, in order to render possible the desired displacement of the material, it is necessary to install power means for controlling the jacks which are substantially more considerable than those which would correspond to the production of movements of the bucket either in penetration or in lifting.

The invention intends to remedy the above-mentioned drawbacks of known loaders, by proposing a novel arrangement of the jacks for adjusting the position of the arms. Its application is not directed only to loaders, moreover, although the origin of its design is in the production of loaders, but is directed more generally to the control of the position of the arms of a loader type machine, or of the shovel type (of which the bucket is back-acting).

To this end, the invention relates to a method for determining the locations of the two hydraulic jacks for controlling an assembly of two pivoted arms, the first arm, called boom or jib, pivoted on the frame of a public works machine, such as a loader or a hydraulic shovel, and the second arm, called balance beam, pivoted on the first arm, whilst a bucket, adapted to rest on the ground during loading, is coupled to said balance beam, each of said two jacks being coupled between the frame and the balance beam, at least one of the axes of coupling of one of the jacks being separate from the axis of coupling of the other jack on the same element—frame or balance beam—, and the instantaneous centres of rotation of the bucket, corresponding respectively to the functioning of each of the control jacks when the bucket is near the ground, are chosen to be on the longitudinal axis of the boom.

According to this method, the first instantaneous centre of rotation is chosen to be near the ground, the second instantaneous centre of rotation is chosen to be substantially perpendicular with respect to the position of the bucket resting on the ground at the moment of loading and the longitudinal axes of the control jacks are placed on radii passing respectively through each of said centres of rotation, the axes of coupling of the jacks to the balance beam and to the frame being determined by the intersections of said radii with each of these elements.

One or more of the following arrangements are advantageously adopted:

- the first instantaneous centre of rotation is chosen to be beneath ground level;
- the radii passing through the centres of rotation intersect the frame at the same point or at very adjacent points;
- the radii passing through the centres of rotation intersect the balance beam at the same point or at very adjacent points;
- the two control jacks are placed on the same side with respect to the boom;
- the two jacks are placed on either side of the boom.

Figure 3:
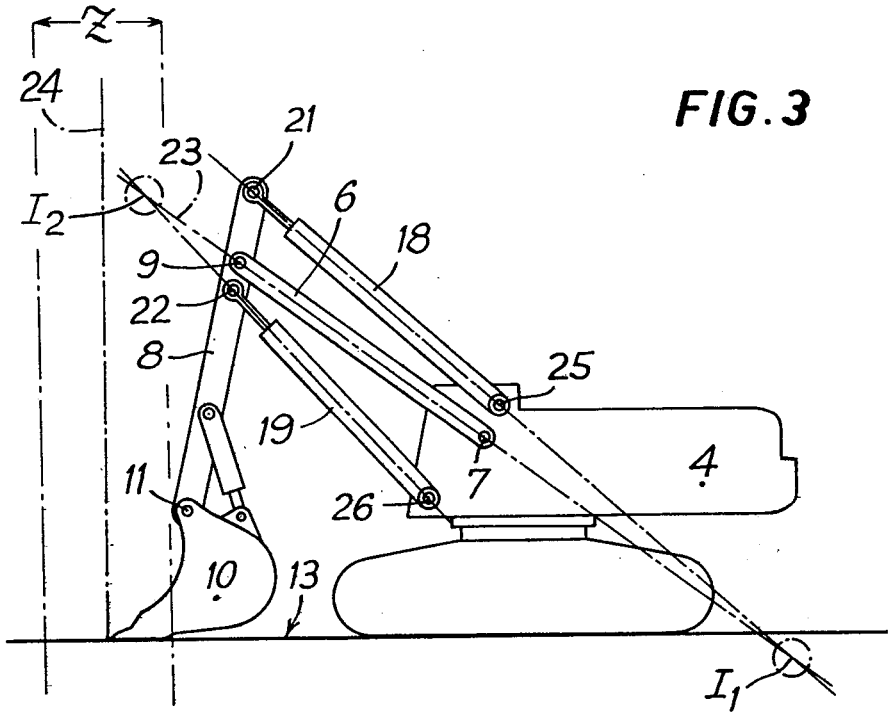
Figure 4:
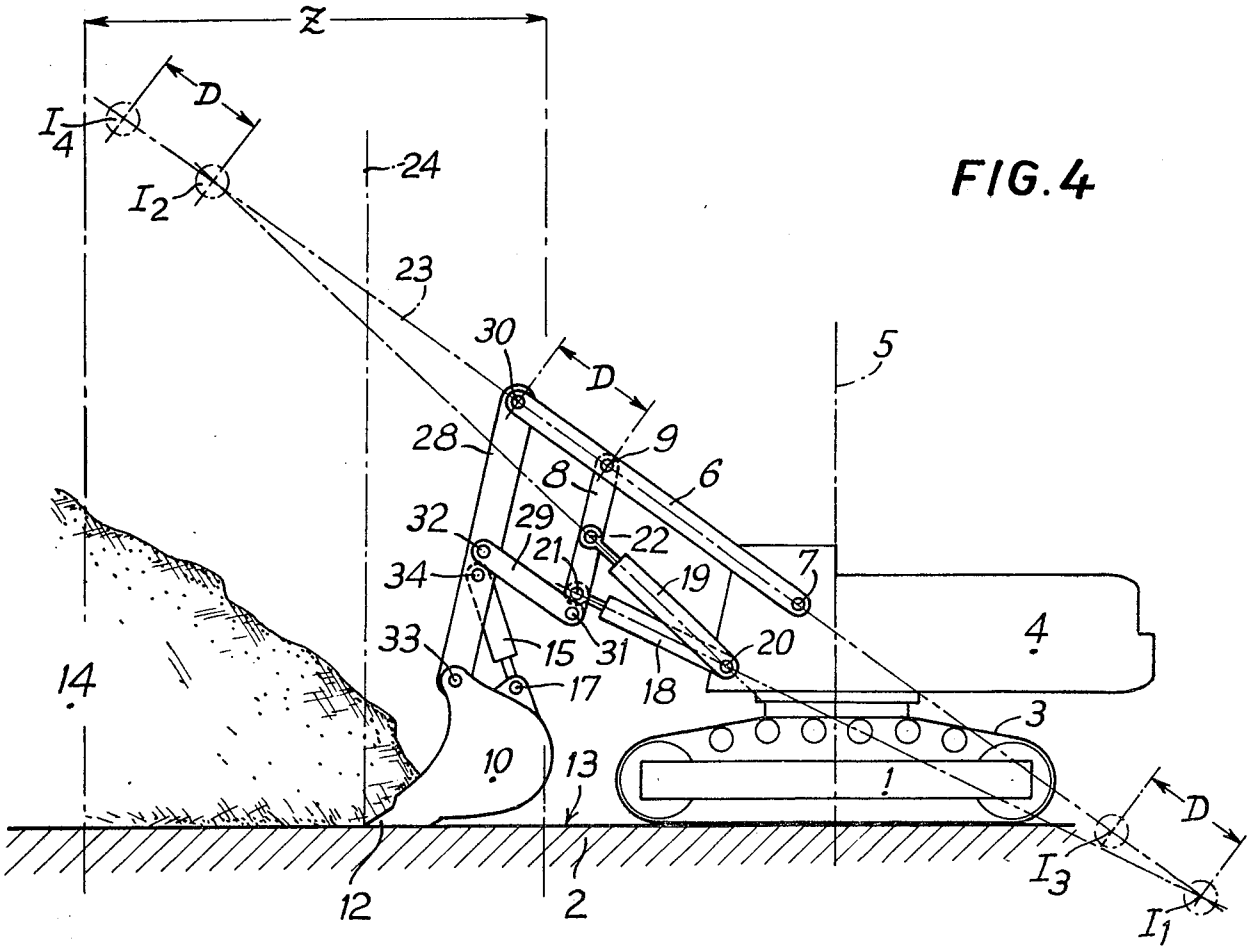
Figure 5:
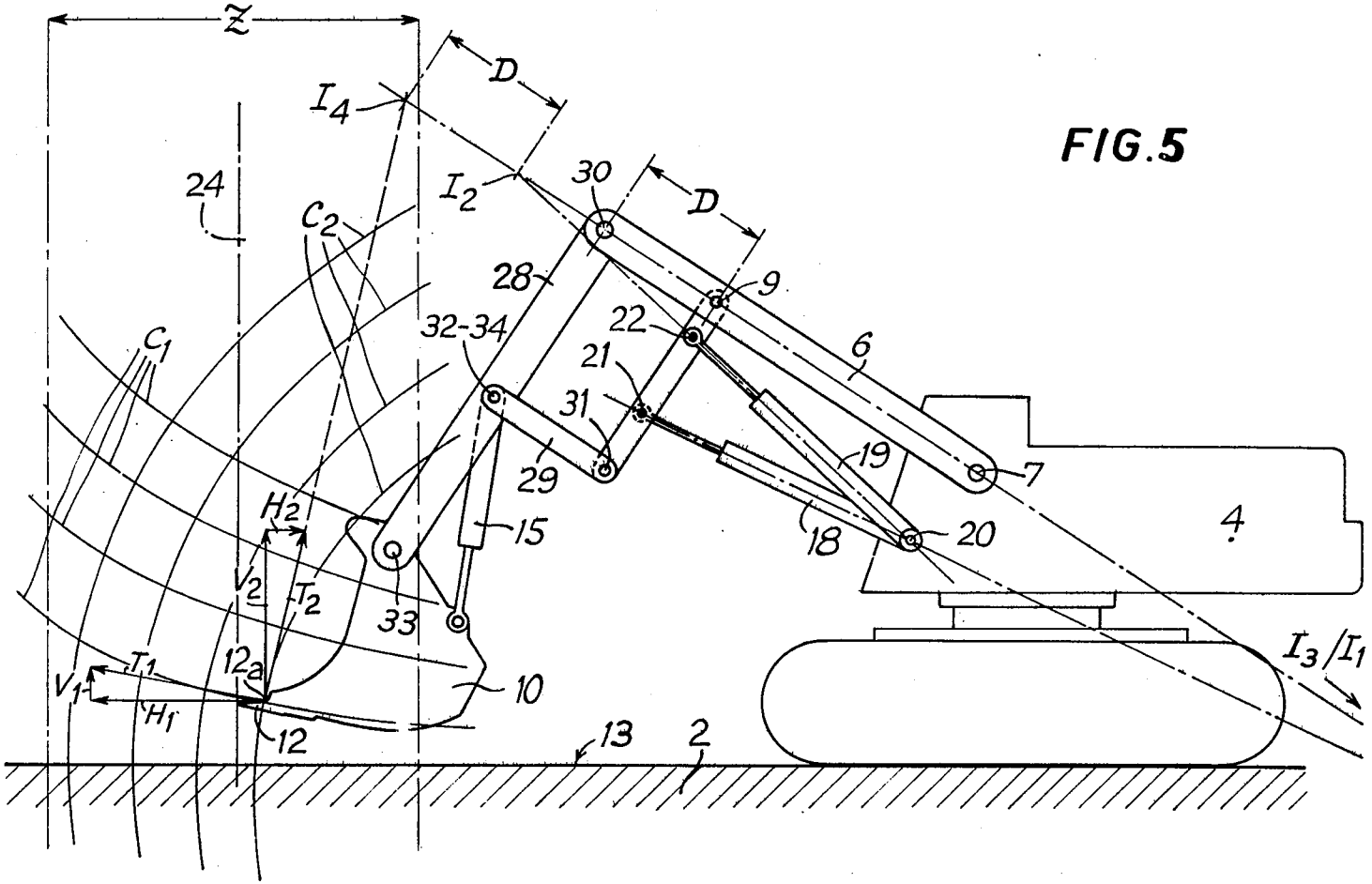

The invention will be more readily understood on reading the following description with reference to the accompanying drawings, in which:

FIGS. 1 to 4 are elevation views of four loaders made according to the method of the invention, and FIG. 5 shows the functional diagram of the "loading" equipment illustrated.

Referring now to the drawings, FIG. 1 shows a loader which is constituted by:

- a chassis 1 which is supported on the ground 2 by endless tracks 3,
- a turret 4 which is rotatably mounted on the chassis 1 about a vertical axis 5,
- a first arm 6, called boom or jib, which is pivoted on the turret 4 about a horizontal axis 7,
- a second arm 8, called balance beam, which is pivoted on the end of the boom 6 about an axis 9 parallel to axis 7, and
- a bucket 10 pivoted at the end of the balance beam 8 about an axis 11 also parallel to axis 7.

The penetrating blade 12 of the bucket 10 is located at surface level 13 of the ground 2 and penetrates into a heap 14 of material which is to be displaced.

In the example shown, the assembly composed of the chassis 1 and turret 4 constitutes the frame of the machine, which machine, as a variant, could be monobloc (without rotating turret).

It will be noted that the jacks are coupled between the elements constituting the working equipment. These are:

- the jack 15, disposed between the balance beam 8 and the bucket 10, being pivoted on the balance beam about an axis 16 and on the bucket about an axis 17, and
- jacks 18 and 19, disposed between the turret 4 and the balance beam 8, being pivoted on the turret 4 about a common axis 20 and on the balance beam about separate axes 21 and 22, respectively.

The axes 16, 17, 20, 21 and 22 are parallel to the pivot axis 7 of the boom 6 on the turret 4.

The following method should be noted for the determination of the locations of the jacks 18 and 19, the bucket 10 resting on the ground 2 in the configuration which allows loading thereof:

- two points $I_1$ and $I_2$ are firstly chosen on axis 23 of the boom 6;
- the point $I_1$ is placed near the surface 13 of the ground and, in the present case, slightly below this surface;
- the point $I_2$ is placed beyond the pivot axis 9 of the balance beam on the boom with respect to point $I_1$ and, in the present case, beyond the vertical 24 passing through the penetrating blade 12 of the bucket with respect to bucket 10;
- the function of instantaneous centres of rotation of the blade 12 is fulfilled by points $I_1$ and $I_2$, when one or the other jacks 18 and 19 is blocked, and, to this end,
- the jacks 18 and 19 are aligned on radii $R_1$ and $R_2$ passing respectively through $I_1$ and $I_2$.

The pivot axes 20–21 and 20–22 of the jacks 18 and 19 are then placed both on said radii $R_1$ and $R_2$ and on the elements on which they are pivoted: the turret 4 concerning the axis 20, the balance beam 8 concerning the axes 21 and 22.

For the loader of FIG. 1, a particular choice has been made, the result being that the pivot axes of the jacks 18 and 19 on the turret 4 are merged into one single axis 20.

Figure 2:
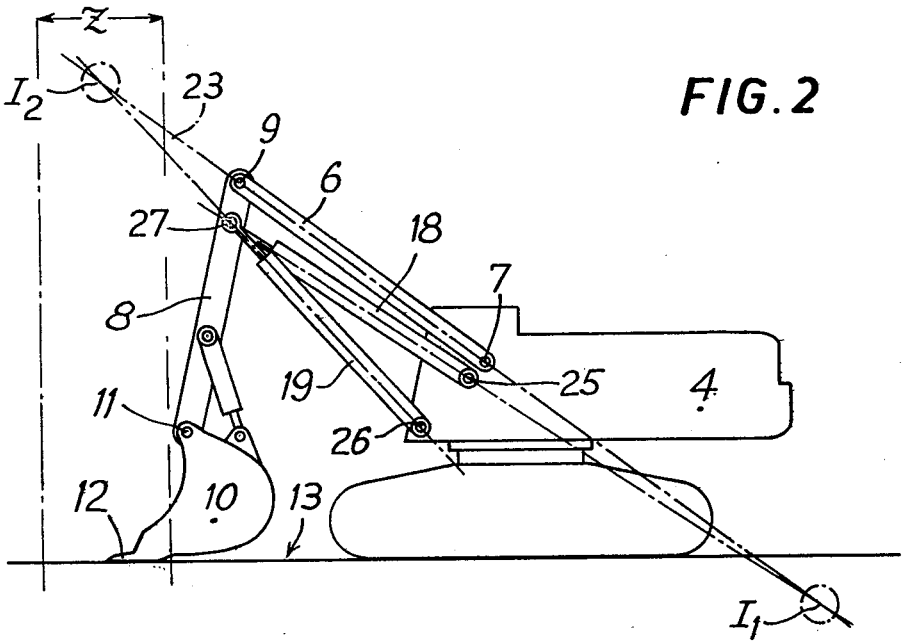

These axes could have been separate, as in the embodiments of FIGS. 2 and 3 where they are referenced 25 and 26 and correspond to jacks 18 and 19, respectively.

In the embodiment of FIG. 2, the pivot axes of jacks 18 and 19 on the balance beam 8 are, on the contrary, merged in one single axis 27.

Finally, the jacks 18 and 19 may have no common pivot axis (FIG. 3).

Furthermore, the jacks 18 and 19 may be disposed on the same side of the axis 23 of the boom 6 (FIGS. 1 and 2) or, on the contrary, on either side of this axis 23 (FIG. 3).

A variant embodiment of the loader of FIG. 1 is shown in FIG. 4.

The boom 6, balance beam 8 and jacks 18 and 19 are to be found again, as these elements have already been described. On the contrary, it is noted that the bucket 10 is no longer pivoted at the end of the balance beam 8, but at the end of an arm 28 parallel to said balance beam. In cooperation with a connecting rod 29, the arm 28, the balance beam 8 and the boom 6 form a deformable parallelogram of which the apices are the following pivot axes:

- axis 9 of the balance beam 8 on the boom 6;
- axis 30 of the arm 28 on the boom 6,
- axes 31 and 32 of the connecting rod 29 on the balance beam 8 and on the arm 28, respectively.

The bucket 10 is pivoted on the arm 28 about an axis 33, whilst its control jack 15 is pivoted on the arm 28 about an axis 34.

It will further be noted that two new points $I_3$ and $I_4$ follow from previously defined points $I_1$ and $I_2$ by a translation of value D along the axis 23 of the boom 6, D being the distance separating the axes 9 and 30, respectively. These points $I_3$ and $I_4$ constitute the new instantaneous centres of rotation of the blade 12 of the bucket, the jacks 18 and 19 being, however, placed, as in the other embodiments, from the points $I_1$ and $I_2$, for reasons of simplicity of determination.

A machine having the same constitution as that of FIG. 4 is shown in FIG. 5. All the elements constituting it have already been designated. It is noted in this Figure, on the one hand, that the point $I_4$ is located near the vertical 24, but on the same side as the machine, on the other hand, that a particular point **12*a* of the edge 12 has been marked to effect the contour of its various positions when the jacks 18 and 19 are controlled, only one of them at a time. The jack 15 being blocked, a network is obtained of the following two distinct types of curves followed by the point 12*a***:

- when the jack 19 is blocked (constant length) and the functioning of the jack 18 is controlled, the point **12*a*** moves over the curve $C_1$ on which it is disposed at the start;
- when, on the contrary, the length of the jack 18 is maintained constant, by controlling the functioning of the jack 19, the point **12*a*** moves over curve $C_2$ on which it is disposed at the start.

In the position of the bucket 10 shown in FIG. 5, which corresponds to the active configuration of loading of the bucket, said latter will move subsequently, according to whether jack 18 or jack 19 will be controlled, the other jack 19 or 18 being left blocked, by being directed initially from point **12*a*** following the directions of the tangents $T_1$, $T_2$ to curves $C_1$, $C_2$.

The tangent $T_1$, in the direction of penetration of the bucket in the material, has a horizontal component $H_1$ and an ascending vertical component $V_1$. $V_1$ has a low value and $T_1$ is virtually equal to $H_1$. This first ascertainment is very important, as its significance is that the effort of penetration will produce a virtually horizontal displacement of the bucket and will not be dissipated in unfavourable parasitic displacements. The only parasitic displacement is that represented by the vertical component $V_1$ of the displacement. However, the effect of this component, on the one hand, is not a hindrance in view of its low value, and on the other hand, is beneficial as it tends to disengage the blade 12 upwardly.

The tangent $T_2$ naturally corresponds to the movement of disengagement of the bucket after its loading. The vertical component $V_2$ of $T_2$ is large and virtually equal to $T_2$, whilst the horizontal component $H_2$ of $T_2$ is small and is directed rearwardly in the direction opposite the loading of the bucket. There again, all this is satisfactory, as the interpretation of these ascertainments is that, on the one hand, the direction of the displacement of elevation of the bucket after loading thereof is substantially vertical and corresponds to the lifting effort, on the other hand, the parasitic horizontal displacement ($H_2$) which corresponds to a withdrawal of the bucket opposite the displacement provoking the loading, is beneficial, as the bucket is disengaged from the material, this facilitating the lifting.

It should be noted that the instantaneous centres of rotation of the displacements of point **12*a*** along the curves $C_1$ and $C_2$ are:

- $I_4$ concerning the displacement along a curve $C_1$;
- $I_3$ concerning the displacement along a curve $C_2$.

The following points should also be observed:

- it is important to choose the location of the centre $I_2$ or of the centre $I_4$ which is associated therewith (FIGS. 4 and 5), near the perpendicular of the penetration blade 12 of the bucket (FIGS. 2, 3 and 5), or even slightly in front of the vertical passing through this penetrating blade (FIGS. 1 and 4), within a zone Z surrounding the bucket without substantially going beyond its rear end;

it is expedient, and preferred, to choose the centre $I_1$, or the centre $I_3$ associated therewith (FIGS. 4 and 5), near the ground (FIGS. 3 and 4) and even preferably slightly below the ground (FIGS. 1, 2 and 5).

The first condition is important, as, when it is not fulfilled, and, for example, the centre $I_2$ is located outside of the zone Z and too much to the rear of the rear end of the bottom of the bucket of a loader, the curves $C_1$ obtained by instantaneous rotation about $I_2$ are very inclined (45° or more) with respect to the horizontal, and are therefore very poor concerning the qualities of penetration of the bucket. This is particularly the case of a machine described in French patent application No. 2 264 139, which, not adopting the specifications recommended in the present patent application, is entirely unsuitable for obtaining the highly advantageous result obtained by means of the arrangements claimed.

The second condition is less imperative, as tests have shown that, even with a centre $I_1$ (or $I_3$) disposed slightly above the ground, the corresponding curves $C_2$ were not poor. Nevertheless, the best curves $C_2$ relative to a loader are obtained by adopting the recommended arrangement.

The great interest of the machines described hereinbefore resides in the satisfactory adaptation of the displacements of the bucket during the two essential phases of its use: loading, then elevation, and in the simplicity of the controls enabling the desired functioning to be obtained. In fact, the control of one of the jacks, the other being blocked, allows the optimum displacement to be obtained. The recommended arrangement is novel and the satisfactory adaptation mentioned above is also novel.

Of course, the choice of the variant embodiment adopted depends on the project studied, and particularly on the power of the machine.

What is claimed is:

1. A public works machine comprising:
a frame;
a boom pivoted at a first pivot point to said frame;
a balance beam pivoted at a second pivot point to said boom;
a bucket;
means for coupling said bucket to said balance beam;
said bucket being adapted to rest on the ground during the loading thereof;
a first hydraulic jack pivoted at a third pivot point to said frame and at a fourth pivot point to said balance beam;
a second hydraulic jack pivoted at a fifth pivot point to said frame and at a sixth pivot point to said balance beam;
at least one pair of said third and fifth and said fourth and sixth pivot points being spaced apart;
a line and extensions thereof joining said first and second pivot points defining a first axis;
said bucket having first and second centers of rotation corresponding to functioning of said first and second hydraulic jacks respectively;
said first and second centers of rotation falling substantially on said first axis when said bucket is near the ground;
said first center of rotation being near ground level when said bucket is near the ground;
said second center of rotation being substantially vertically above said bucket when said bucket is near the ground in a loading position;
a line and extensions thereof joining said third and fourth pivot points defining a second axis;
said second axis passing through said first center of rotation;
a line and extensions thereof joining said fifth and sixth pivot points defining a third axis; and
said third axis passing through said second center of rotation.

2. A public works machine according to claim 1, wherein said first center of rotation is beneath the ground when said bucket is near the ground in a loading position.

3. A public works machine according to claim 1, wherein said second and third axes intersect said frame at substantially the same point.

4. A public works machine according to claim 1, wherein said second and third axes intersect said balance beam at substantially the same point.

5. A public works machine according to claim 1, wherein said first and second hydraulic jacks are pivoted on the same side of said boom.

6. A public works machine according to claim 1, wherein said first and second hydrualic jacks are pivoted on opposite sides of said boom.

7. A public works machine comprising:
a frame;
a bucket;
a boom pivoted at a first pivot point to said frame;
a balance beam pivoted at a second pivot point to said boom;
a first hydraulic jack pivoted at a third pivot point to said frame and at a fourth pivot point to said balance beam;
a second hydraulic jack pivoted at a fifth pivot point to said frame and at a sixth pivot point to said balance beam;
means for coupling said bucket to said balance beam;
said bucket having a loading position;
a first center of rotation corresponding to operation of said first hydraulic jack;
a second center of rotation corresponding to operation of said second hydraulic jack;
first means for positioning said first center of rotation substantially at ground level when said bucket is in said loading position; and
second means for positioning said second center of rotation substantially vertically above said bucket when said bucket is in said loading position.

8. A public works machine according to claim 7, wherein said first means includes:
a line and extensions thereof joining said first and second pivot points defining a first axis;
a line and extensions thereof joining said third and fourth pivot points defining a second axis; and
said first axis and said second axis intersecting at said first center of rotation.

9. A public works machine according to claim 7, wherein said second means includes:
a line and extensions thereof joining said first and second pivot points defining a first axis;
a line and extensions thereof joining said fifth and sixth pivot points defining a third axis; and
said first axis and said third axis intersecting at said second center of rotation.

10. A public works machine according to claim 7, wherein said means for coupling said bucket to said balance beam includes:

an arm pivoted to said boom;

said bucket being pivoted to said arm;

a connecting rod disposed substantially parallel to said boom and being pivoted to said arm and said balance beam; and said connecting rod being effective to hold said arm substantially parallel to said balance beam.

* * * * *